US005832692A

United States Patent [19]

Opferbeck et al.

[11] Patent Number: 5,832,692

[45] Date of Patent: Nov. 10, 1998

[54] PANEL CONSTRUCTION AND METHOD FOR MANUFACTURING

[75] Inventors: Kevin W. Opferbeck, Ashville; Donald J. Krug; Lawrence P. Tocha, both of Little Valley, all of N.Y.

[73] Assignee: Bush Industries, Inc., Jamestown, N.Y.

[21] Appl. No.: 621,472

[22] Filed: Mar. 25, 1996

Related U.S. Application Data

[60] Provisional application No. 60/002,906, Aug. 29, 1995.

[51] Int. Cl.[6] ..... E04C 2/10; E04C 2/34

[52] U.S. Cl. ..... 52/745.19; 52/783.1; 52/782.2; 52/784.16; 52/795.1; 52/796.12; 52/797.1

[58] Field of Search ..... 52/783.1, 782.2, 52/784.1, 784.16, 784.14, 793.1, 793.11, 795.1, 796.12, 797.1, 796.11, 745.19

[56] References Cited

U.S. PATENT DOCUMENTS

| | | | |
|---|---|---|---|
| 435,337 | 8/1890 | Wassensius | 52/782.2 X |
| 1,876,772 | 9/1932 | Sievers | 52/784.1 |
| 2,020,044 | 11/1935 | Tesek | 52/784.1 |
| 2,108,479 | 2/1938 | Elmendorf | 52/793.11 |
| 2,701,746 | 2/1955 | Piggott . | |
| 2,706,164 | 4/1955 | Hervey | 52/793.11 X |
| 2,791,809 | 5/1957 | Lincoln, Jr. | 52/784.1 X |
| 2,813,766 | 11/1957 | Shumaker et al. | 52/796.12 X |
| 3,325,233 | 6/1967 | Oppenhuizen et al. . | |
| 4,093,762 | 6/1978 | Kiefer . | |
| 4,235,057 | 11/1980 | Teeters . | |
| 4,360,021 | 11/1982 | Stima . | |
| 4,429,012 | 1/1984 | Danko . | |
| 4,624,094 | 11/1986 | Schwindt . | |
| 4,635,425 | 1/1987 | Cova . | |
| 4,741,945 | 5/1988 | Brant et al. . | |
| 4,753,696 | 6/1988 | Monzo . | |
| 4,843,781 | 7/1989 | Chase, III . | |
| 4,894,974 | 1/1990 | Mayhew et al. . | |
| 5,077,948 | 1/1992 | Olson et al. . | |
| 5,085,027 | 2/1992 | McClung et al. | 52/782.2 X |
| 5,197,256 | 3/1993 | Martin | 52/793.1 |
| 5,369,930 | 12/1994 | Kreizinger . | |
| 5,396,750 | 3/1995 | Kleyn . | |

FOREIGN PATENT DOCUMENTS

| | | | |
|---|---|---|---|
| 876313 | 11/1942 | France | 52/783.1 |
| 1013087 | 7/1952 | France | 52/783.1 |
| 1101526 | 10/1955 | France | 52/783.1 |
| 1347082 | 11/1963 | France | 52/783.1 |
| 929028 | 6/1955 | Germany | 52/793.11 |
| 7310525 | 2/1975 | Netherlands | 52/795.1 |
| 86407 | 5/1936 | Sweden | 52/783.1 |
| 114548 | 7/1945 | Sweden | 52/783.1 |
| 132895 | 9/1951 | Sweden | 52/783.1 |
| 9566 | 11/1894 | Switzerland | 52/783.1 |
| 285871 | 1/1953 | Switzerland | 52/783.1 |
| 314233 | 7/1956 | Switzerland | 52/783.1 |
| 553254 | 5/1943 | United Kingdom | 52/783.1 |

*Primary Examiner*—Carl D. Friedman
*Assistant Examiner*—Laura A. Callo
*Attorney, Agent, or Firm*—Webb Ziesenheim Bruening Logsdon Orkin & Hanson, P.C.

[57] ABSTRACT

A hollow panel for use in making furniture and other products. The panel includes a plurality of side rails and interior blocks positioned vertically and adhesively secured to outer sheets. The blocks and the side rails are made of offal or scrap products. Preferably, a template is used to manufacture the panels and a vacuum is used to attach one of the panels to the side rails and blocks. Also disclosed are a method and a device to make the panel.

8 Claims, 9 Drawing Sheets

PANEL CONSTRUCTION AND METHOD FOR MANUFACTURING

CROSS REFERENCE TO RELATED APPLICATION

This application claims the benefit of U.S. provisional application Ser. No. 60/002,906, filed on Aug. 29, 1995.

BACKGROUND OF THE INVENTION

1. Field of the Invention

This invention relates to panels and, more particularly, to hollow panels which can be used in furniture and other products.

2. Description of the Prior Art

Prior to the twentieth century, furniture makers manufactured furniture from solid wood and by hand. Much of the furniture, such as tables and desks, also featured an outer veneer. Generally, this furniture was expensive.

During the twentieth century, furniture manufacturing techniques improved. This resulted in the mass production of many wooden furniture products at a relatively inexpensive cost to the purchaser. However, with the advent of plastic furniture and "knockdown" furniture, the demand for solid wood furniture decreased, primarily because of cost. Further, the cost of furniture grade wood has increased drastically in recent years, causing many furniture manufacturers to react by creating alternatives to solid wood panels for furniture.

Recently, some furniture manufacturers have turned to the use of solid furniture panels made of particle board having veneered surfaces. Although these panels can be substituted for wooden panels, they are extremely heavy, due to the makeup of particle board (wood and glue). Alternatively, lightweight hollow panels have been used, where each hollow panel includes two sheets sandwiching a plurality of side rails. Measures have been used to stiffen these hollow panels, such as the use of honeycomb inserts or a ladder construction within the interior of the panel.

It is an object of the present invention to provide a lightweight, inexpensive panel for use in furniture.

Also, manufacturing wooden furniture results in an excessive amount of scrap or offal. The offal is due to several aspects of the manufacturing process, namely: (1) the manufactured product does not meet minimum specifications; (2) excess product is in inventory; and (3) scrap is produced by cutting and shaping the panels into a final product. This offal results in higher costs for the final product due to added material costs and disposal costs of the offal. Disposal costs can easily run into thousands of dollars.

A prior art panel that utilizes offal is shown in FIGS. 1*a* and 1*b*. The panel 1 includes two outer plywood sheets 2, each sheet having a veneered outer surface and an unfinished inner surface. A plurality of rails 4 are provided about the edges of the sheets 2. A recess is defined by the rails 4. Honeycomb filler 5 and support rails 6 are positioned within the recess. The rails 4 and 6 are glued to the unfinished surfaces of the sheets 2.

The rails 4 and 6 are made of offal. The offal rails 4 and 6 are made from particle board or fiberboard panels 7 as shown in FIG. 1*c*. The fiberboard panel 7 is a solid member made up of a plurality of horizontally extending planar layers 8, where the outer layers 9*a* and 9*b* are veneer. The veneer extends in a horizontal direction. The rails 4 and 6 are made by removing veneer layers 9*a* and 9*b* either by planing or sanding and forming veneerless or unfinished surfaces. This is done because water-based wood adhesives or glues will not generally adhere to the veneer, which is typically made of a plastic top-coated paper laminate or prefinished wood. The veneerless panels are then cut to form rails 4 and 6. The veneerless surfaces or horizontal surfaces 9*c* are then glued to the unfinished surfaces of the sheets 2.

Although the above panel utilizes offal, there is still considerable waste involved in removing the veneer. Further, there is a substantial cost to modify and remove the veneers. Moreover, the thickness of the rails 4 and 6, and in turn the panel 1, is limited by the thickness of panel 7 minus the thickness of the veneer layers 9*a* and 9*b*. This can result in substantial differences in panel thicknesses from one batch to another and limits the thickness of the finished panels using the offal.

Therefore, it is yet another object of the invention to inexpensively utilize offal in the manufacture of a variety of furniture panels.

SUMMARY OF THE INVENTION

The present invention provides a lightweight, inexpensive panel for use in furniture. One aspect of the invention is a hollow panel having two spaced apart sheets, a plurality of rails, and a plurality of blocks secured to interior surfaces of the sheets. Preferably, each of the sheets is made of particle board and includes a veneered or finished surface and a raw or unfinished surface, wherein the interior surfaces of the sheets are unfinished. The rails extend about a perimeter of the sheets and define an interior area. The blocks are positioned within the interior area. Preferably, the blocks and the rails are made of offal or scrap material, such as particle board. The blocks and the rails can have finished or veneered surfaces and at least two opposite unfinished surfaces. Preferably, the blocks and the rails are machined to a desired dimension perpendicular to the finished or veneered surfaces. The unfinished surfaces of the rails and the blocks are secured to the sheets through an adhesive. The outer exposed rails can be modified after the panel is formed, such as by applying a band or veneer thereto.

Another aspect of the invention is a method for manufacturing a hollow panel that includes the steps of: (a) placing a plurality of rails on a support surface, wherein the rails define an interior area; (b) placing a plurality of blocks within the interior area; (c) adhesively bonding a first sheet onto first surfaces of the rails and the blocks, wherein the first sheet, rails and blocks define a subassembly; (d) rotating the subassembly; (e) exposing second surfaces of the rails and blocks; and (f) adhesively bonding a second sheet to the second surfaces of said rails and blocks, thereby forming a panel. A vacuum can be applied to the interior area of the panel after the first sheet is placed on the upper surfaces of the blocks and rails. Preferably, a template is used to properly orient the blocks and rails prior to adhesive bonding of the first sheet.

Another aspect of the invention is a device for facilitating the practice of the foregoing method of manufacturing a panel. The device includes a support member having a template with indicia for indicating placement of rails and blocks thereon. A conduit defined in the support member is adapted for fluid communication with a vacuum pump. The support member is pivotally secured to a base such that the support member can be rotated from an upwardly facing position to a downwardly facing position.

A complete understanding of the invention will be obtained from a perusal of the detailed description taken in conjunction with the accompanying drawings.

DESCRIPTION OF THE PREFERRED EMBODIMENTS

Figure 1A:
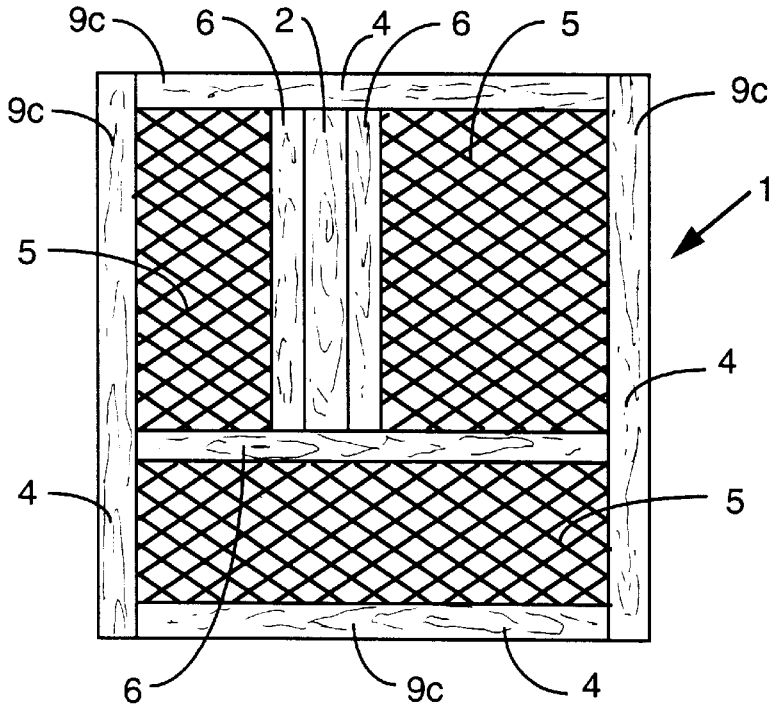
FIG. 1a PRIOR ART
FIG. 1*a* is a top plan view of a portion of a prior art panel.
Figure 1B:
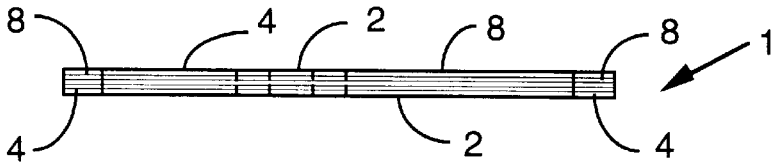
FIG. 1b PRIOR ART
FIG. 1*b* is a side elevational view of the prior art panel of which a portion is shown in FIG. 1*a;*
Figure 1C:
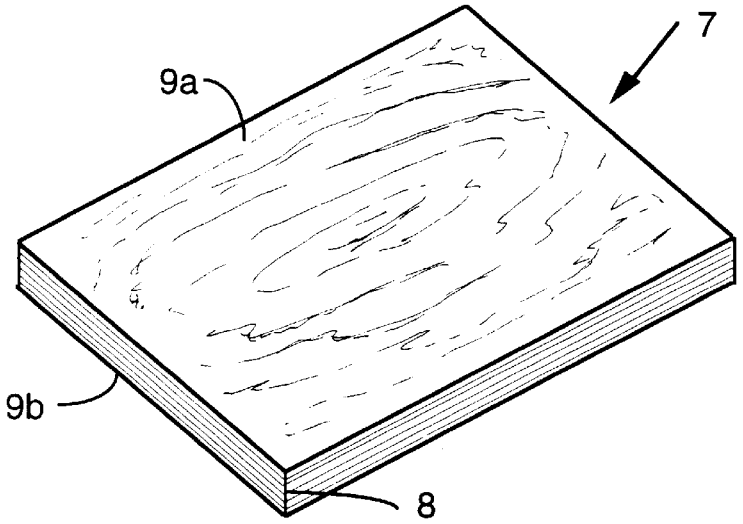
FIG. 1c PRIOR ART
FIG. 1*c* is a top perspective view of a prior art solid fiberboard panel.
Figure 2A:
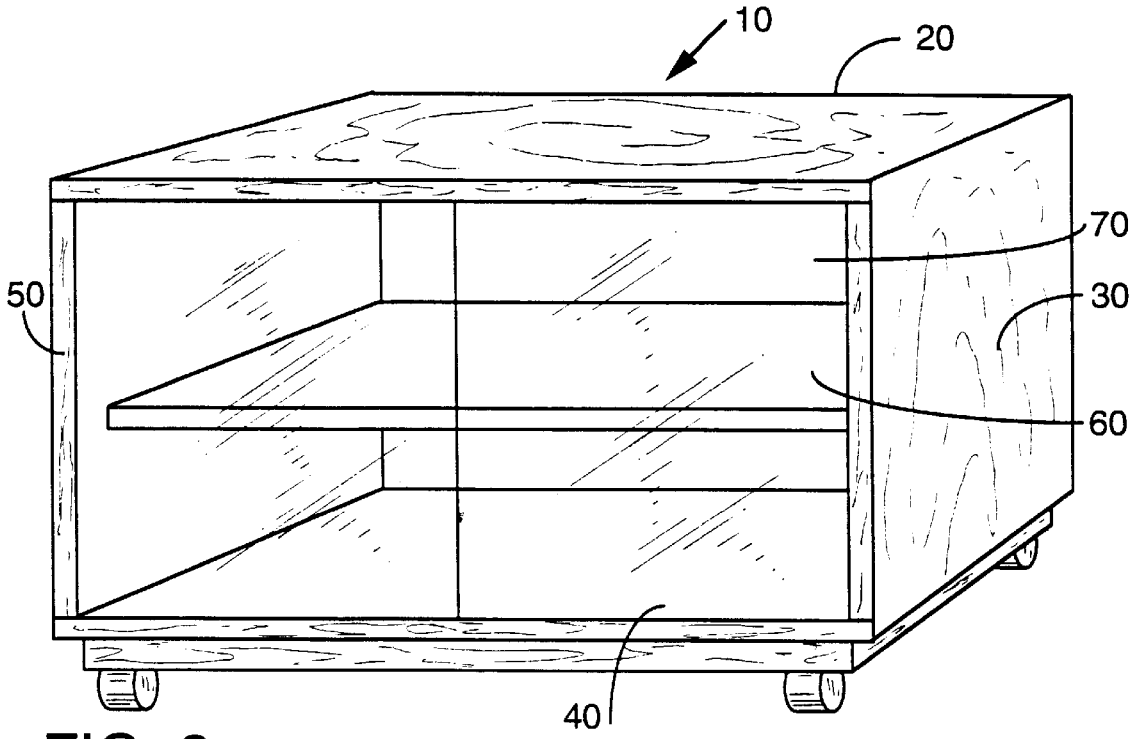
FIG. 2*a* is a perspective view of a piece of furniture incorporating panels made in accordance with the present invention.
Figure 2B:
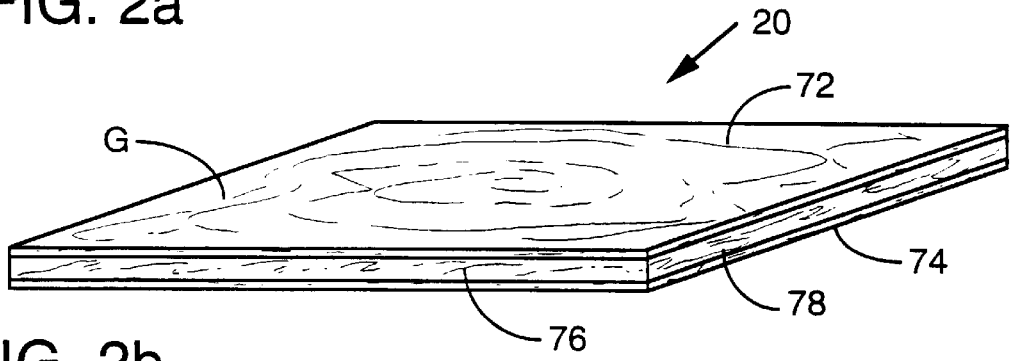
FIG. 2*b* is a perspective view of a panel made in accordance with the present invention.
Figure 3:
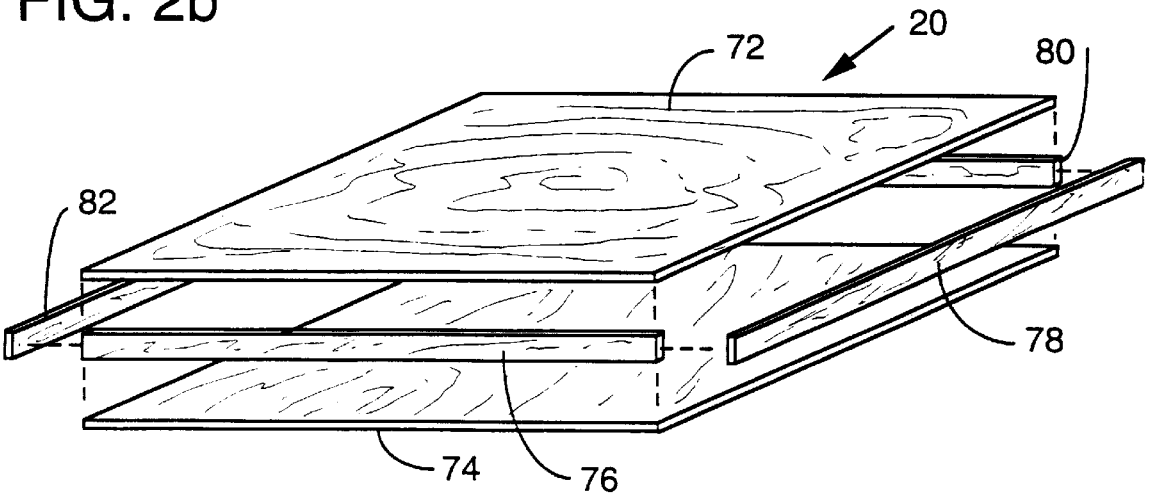
FIG. 3 is an exploded perspective view of veneered or finished surfaces used in the panel shown in FIG. 2.

Referring to FIG. 2*a*, a cabinet 10 including panels 20, 30, 40, 50, 60 and 70 is made in accordance with the present invention. Panels 20, 30, 40, 50, 60 and 70 are rectangular in shape and similar in construction to each other; therefore, only panel 20 will be discussed in detail. Panel 20 is made from two spaced apart sheets sandwiching a plurality of rails and blocks. Outer surfaces of the sheets and rails have laminated veneers or thin layers of material bonded to them. Specifically, as shown in FIGS. 2*b* and 3, panel 20 includes veneers 72 and 74, which are bonded to the outer surfaces of the panel sheets, and veneers 76, 78, 80 and 82, which are bonded to outer surfaces of the rails. The veneers can be made of wood, prefinished paper laminated material or plastic material that simulates the appearance of lacquered wood.

Figure 4:
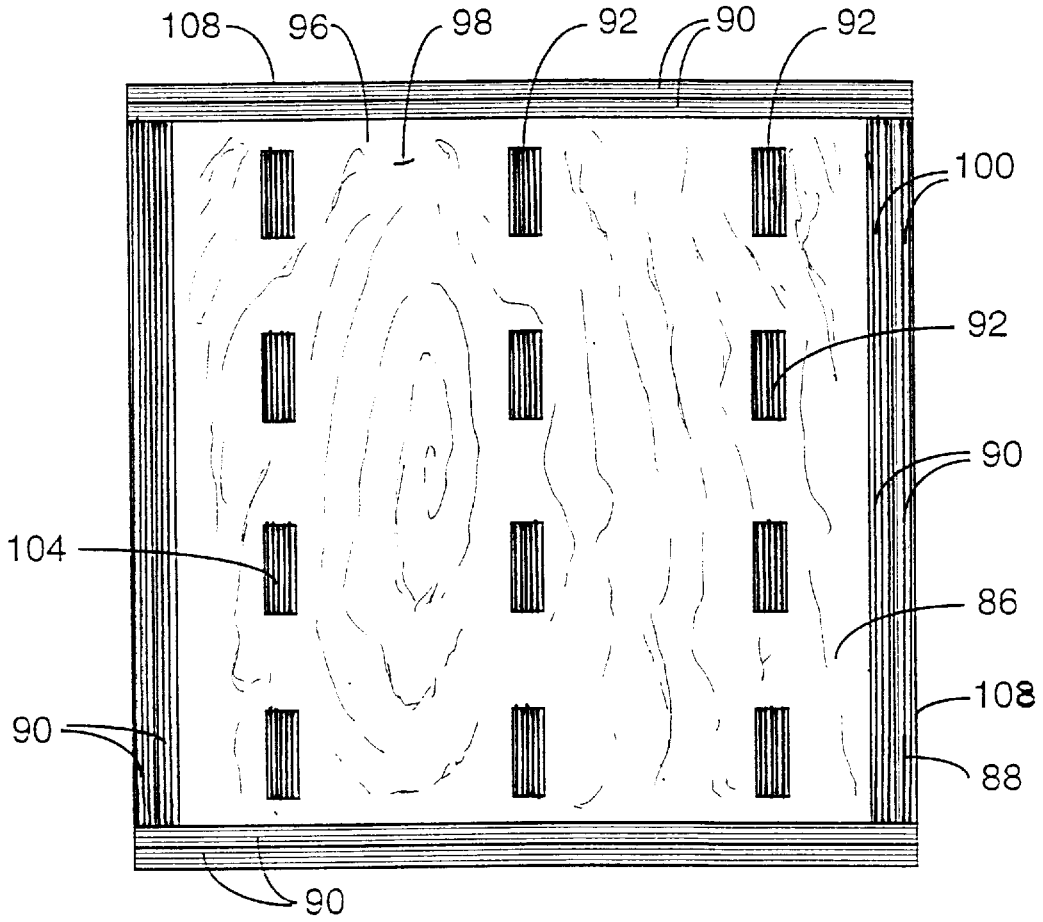
FIG. 4 is a top plan view of a subassembly of the panel shown in FIG. 2.
Figure 5:
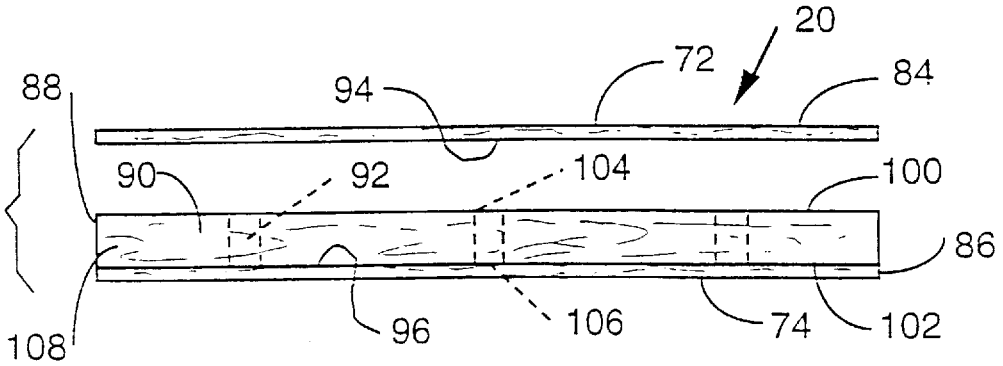
FIG. 5 is a side elevational, partially exploded view of the panels shown in FIG. 2.

Referring to FIGS. 4 and 5, the panel 20 includes two spaced apart hardboard (e.g., particle board), rectangularly shaped sheets 84 and 86, a frame 88 made of a plurality of rails 90 that extend about a perimeter of the sheets 84 and 86 and a plurality of blocks 92. The rails 90 and blocks 92 are secured to and positioned vertically between the sheets 84 and 86 to yield, along with the thickness of the sheets 84 and 86, the final panel thickness. Veneers 72 and 74 form the outer surfaces of the sheets 84 and 86, respectively, and have a horizontally extending grain G as shown in FIG. 2*b*. Inner surfaces 94 and 96 of the sheets are unfinished, i.e., they do not include a veneer. The frame 88 is sandwiched between sheets 84 and 86 and is adhesively bonded or secured to the inner surfaces 94 and 96 of the sheets 84 and 86. As can be seen in FIG. 4, a pair of rails is secured to each edge of the sheet to define an interior area 98. Blocks 92 are positioned within the interior area 98 and are adhesively secured to inner surfaces 94 and 96 of sheets 84 and 86.

Figure 10:
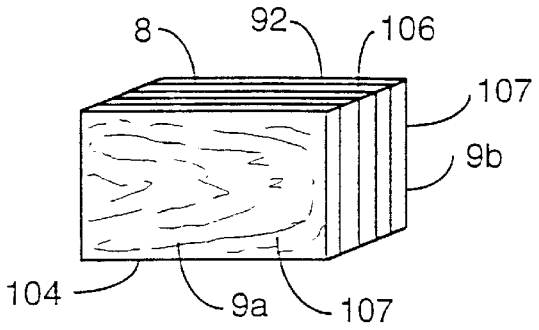
FIG. 10 is a perspective view of a block used in the panels shown FIGS. 4–9.
Figure 11A:
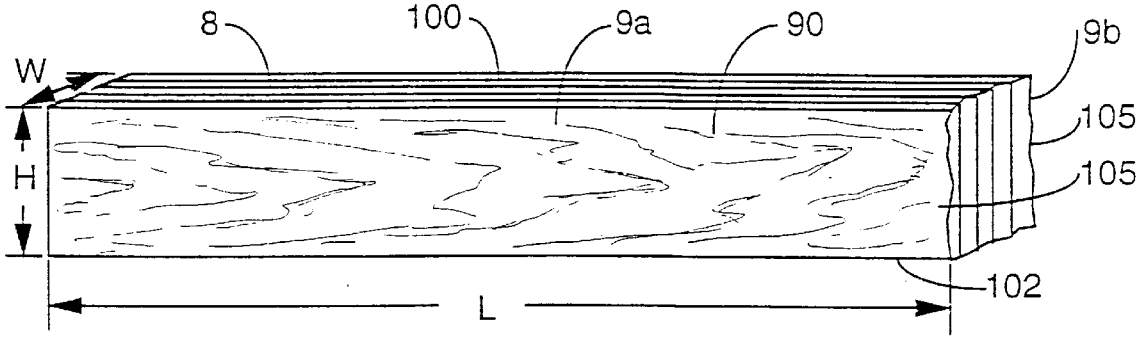
FIG. 11*a* is a perspective view of a rail shown in FIGS. 4–9.
Figure 11B:
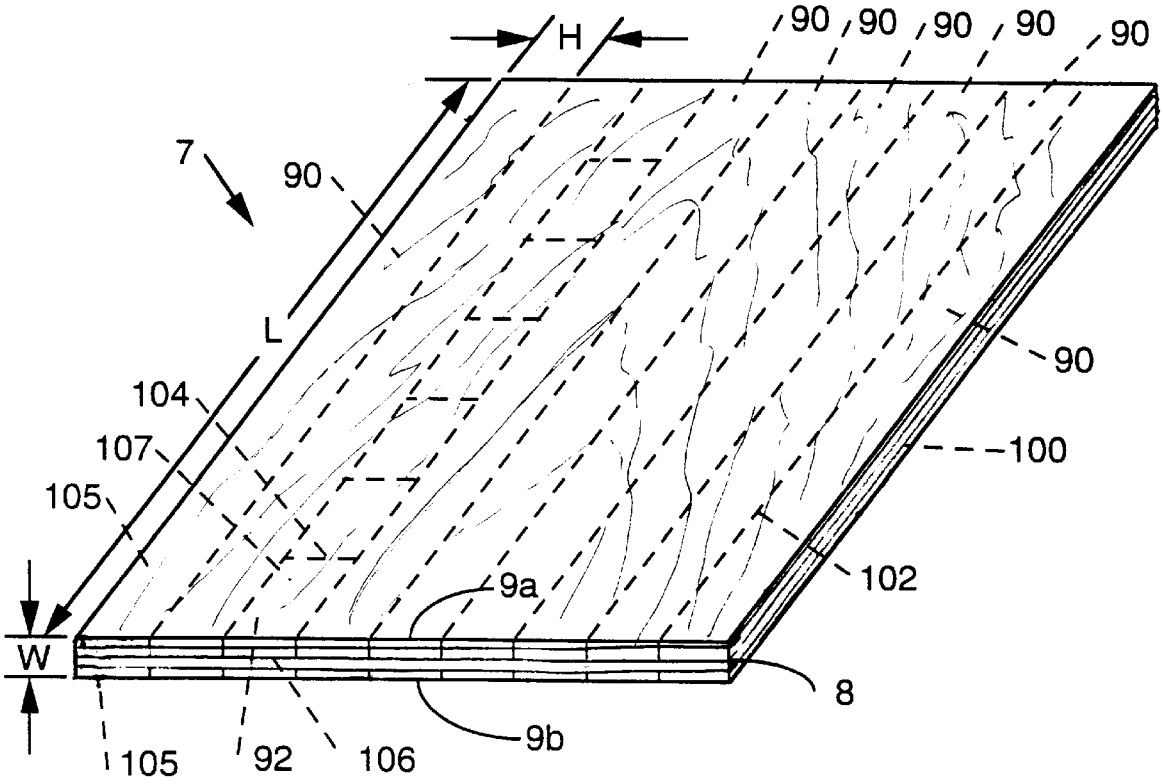
FIG. 11*b* is a perspective view of an offal solid fiberboard panel showing in phantom where rails and blocks can be cut therefrom.

As best shown in FIGS. 10, 11*a* and 11*b*, rails 90 and blocks 92 have a rectangular cross section and are preferably made of offal or discarded material, such as scrap particle board or fiberboard. Rails 90 are longitudinally extending members having two opposite and substantially parallel unfinished surfaces 100 and 102 for adhesively securing them to inner surfaces 94 and 96 of the sheets. The remainder of the surfaces can be finished or veneered. By a finished surface, it is meant a surface made of a veneer or other material to which wood glue or other adhesives will not adhere. Examples of such a finished surface is a prefinished veneer made of plastic or paper based materials. Preferably, the unfinished surfaces 100 and 102 are perpendicular to the veneered or finished surfaces 105. Likewise, only two opposite surfaces 104 and 106 of blocks 92 need to be unfinished and substantially parallel for adhesively securing them to inner surfaces 94 and 96 of the sheets. Preferably, unfinished surfaces 104 and 106 are perpendicular to the finished veneered surfaces 107. It is important to note that wood glue will not sufficiently adhere to veneered surfaces to secure the rails and the blocks to the sheets 84 and 86. This is especially true if the veneer is made of a polymeric material. On the other hand, the wood glue sufficiently adheres to unfinished surfaces of the blocks, rails and sheets so as to adhesively secure the rails 90 and blocks 92 to the sheets 84 and 86. The blocks 92 are strategically placed about the interior area 98 corresponding to the desired locations for screws (and other hardware), dowels, routing, etc. for ready-to-assemble furniture. Additionally, the blocks 92 are positioned throughout the interior area 98 to create sufficient rigidity of the panel 20. The rails 90 and blocks 92 are made by locating offal made of wood products and cutting the offal pieces into suitable lengths for the rails 90 and blocks 92.

A difference between the offal rails 90 and blocks 92 from the prior art rails 4 and 6 made from offal is that the veneer layers 9*a* and 9*b* of the panel 7 are not removed from rails 90 and blocks 92. Where the prior art rails 4 and 6 are secured to the sheets 2 by the machined horizontal surfaces 9*c* of the rails, the rails 90 and the blocks 92 are adhesively secured to the sheets 84 and 86 through their vertical non-veneered or unfinished surfaces 100, 102, 104 and 106 with the veneer that was attached to the horizontal surface of the panel being left in place. The height H of the rails 90 and blocks 92 can be changed on a case-by-case basis, unlike the prior art, where the hollow panel thickness was dictated by the thicknesses of the panel 7 and the veneer layers 9*a* and 9*b*. FIG. 11*b* shows in phantom a fiberboard panel 7 defining various rails 90 and blocks 92.

A veneer band can be secured to the outer exposed rail surfaces 108 after the rails 90 and blocks 92 are adhesively secured to the sheets 84 and 86 in a manner well known in the art. The area around the blocks 92 contained within the interior area 98 forms the hollow portion of the panel 20.

Figure 6:
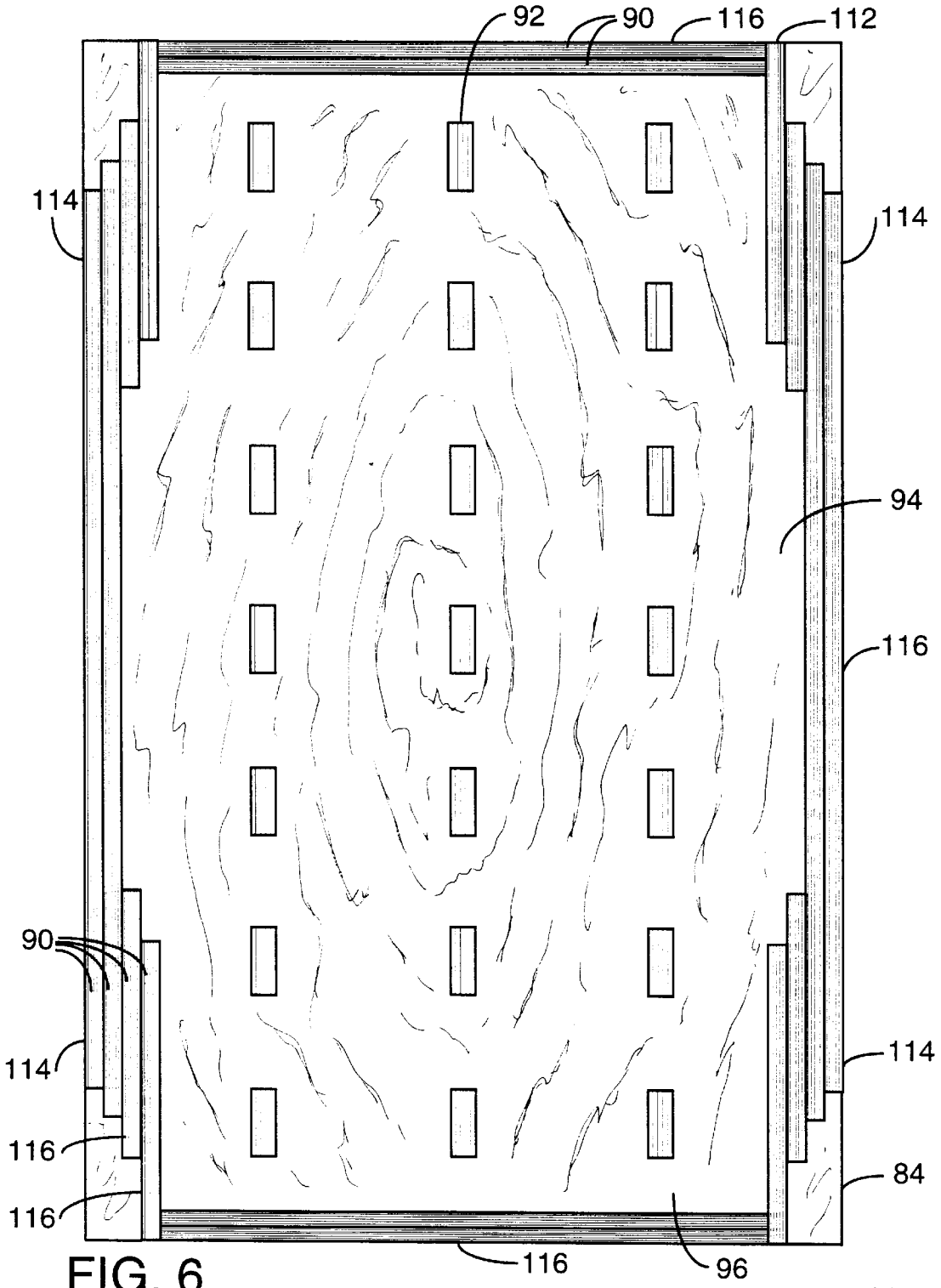
FIG. 6 is a top plan view of a subassembly of a second embodiment of a panel made in accordance with the present invention.
Figure 7:
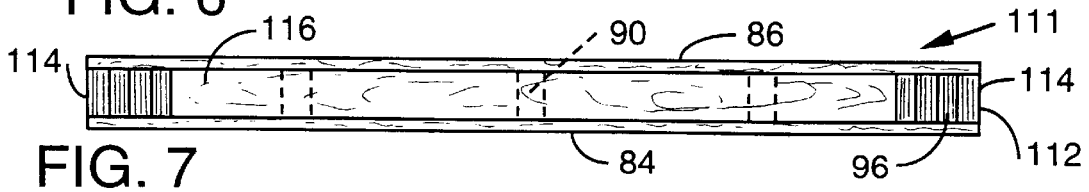
FIG. 7 is a side elevational view of the second embodiment of the panel shown in FIG. 6.
Figure 8:
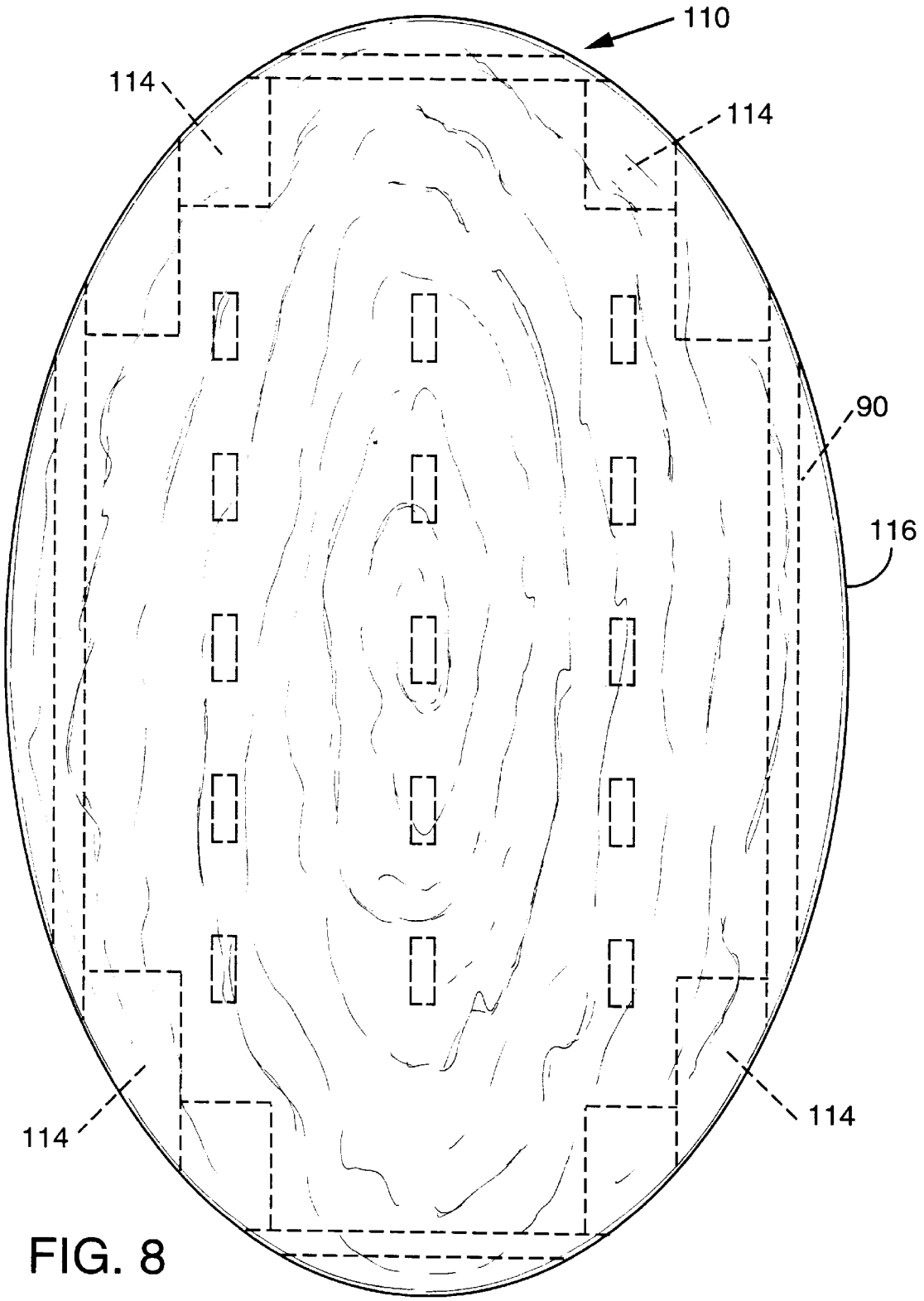
FIG. 8 is a top plan view of an oval-shaped tabletop made from a panel similar to that shown in FIG. 7.
Figure 9:
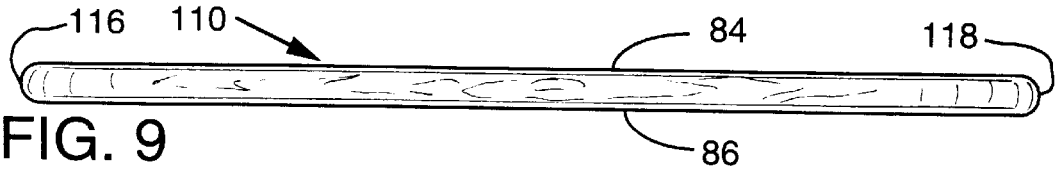
FIG. 9 is a side elevational view of the tabletop shown in FIG. 8.

Panels made in accordance with the present invention need not be limited to square and rectangular shaped panels 20, 30, 40, 50, 60 and 70. FIGS. 8 and 9 show an oval or non-rectangular panel 110 made in accordance with the present invention. The non-rectangular panel 110 includes many of the same elements as previously described. Therefore, like reference numerals are used to designate like elements. Prior to manufacture of the oval panel, an intermediate panel 111 must be formed, as shown in FIG. 7 made from a subassembly 112, shown in FIG. 6. The subassembly 112 includes a hardboard sheet 84 with a plurality of rails 90 and blocks 92 adhesively secured to the inner surface 94 of the sheet 84. A staggered arrangement 114 of side rails, four deep, is disposed adjacent to each corner of the subframe. FIG. 7 shows the intermediate panel with the inner surface 96 of sheet 86 adhesively secured to rails 90 and blocks 92.

Referring again to FIGS. 8 and 9, the oval-shaped panel 110 is made from an intermediate panel similar to intermediate panel Ill and is formed by cutting an oval-shaped profile in the intermediate panel, such that portions of the side rails 90 form edges of the oval panel. The outermost exposed rail surfaces 116 can then be modified. Specifically, the exposed rail surfaces 116 can be machined in a curved profile with respect to the thickness of the panel, as shown in FIG. 9. Also, a veneer band 118 can be applied to the exposed rail surfaces 116 in a manner well known in the art. The oval-shaped panel 110 can be used as a tabletop.

The panels described herein need not be limited to furniture but can also be used for other products, such as doors or for the manufacture of prefabricated walls. The hollow panels are lighter weight than solid panels and stronger than prior art hollow panels. Further, since these panels include components made of offal, they cost less to manufacture and reduce the need to dispose of waste product that normally would be sent to landfills.

Figure 12:
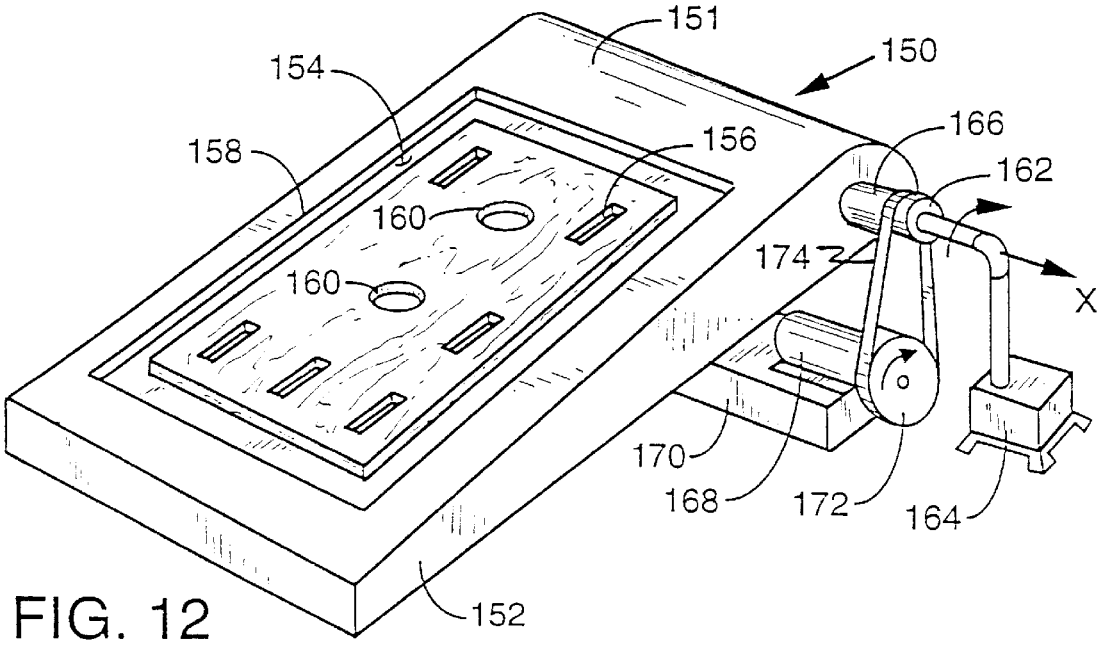
FIG. 12 is a perspective view of an apparatus to make hollow panels made in accordance with the present invention.
Figure 13:
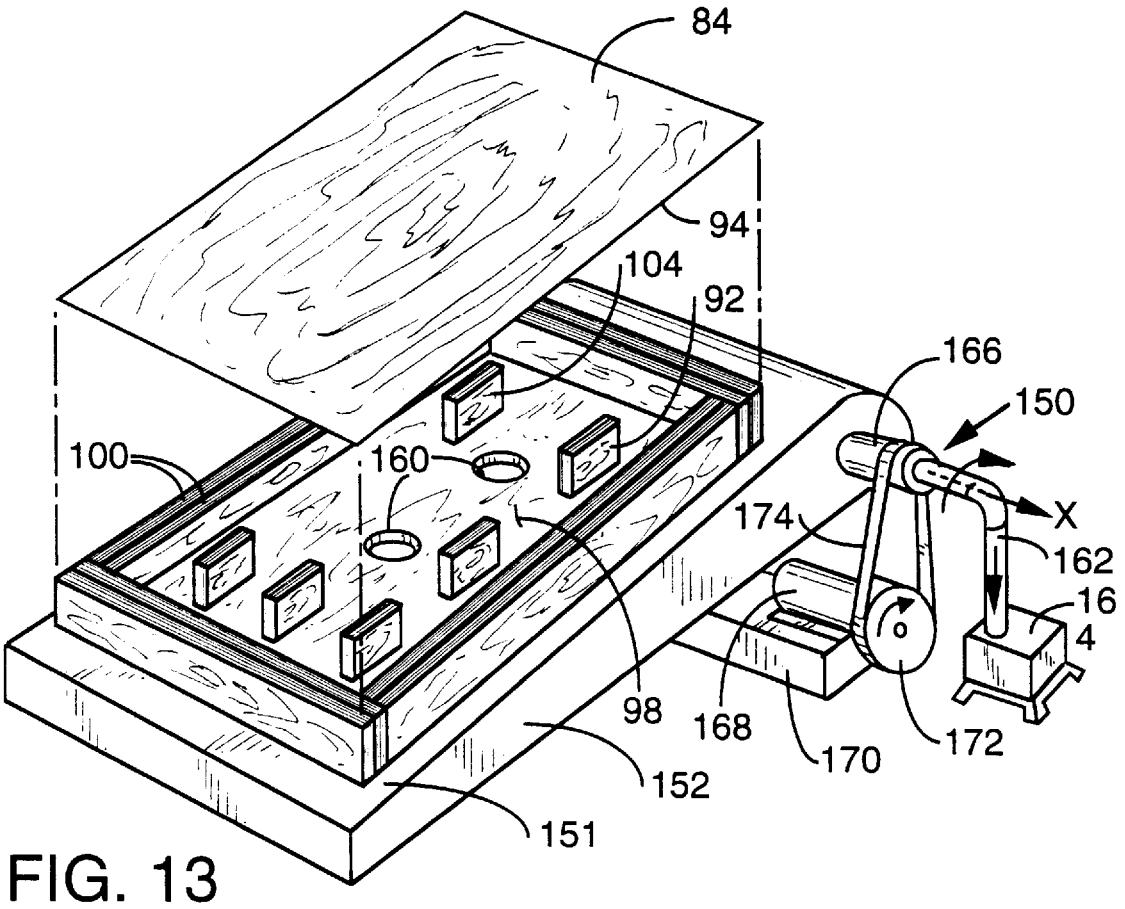
FIG. 13 is an exploded perspective view of a panel subassembly positioned on the apparatus shown in FIG. 12.

FIGS. 12 and 13 show an apparatus 150 made in accordance with the present invention to manufacture panels according to the invention. The apparatus 150 includes a hollow support member 152. A surface 151 of the support member 152 includes a plurality of recesses 154 and 156 adapted to receive rails 90 and blocks 92, respectively. The upper surface 151 and recesses 154 and 156 define a template 158. A chamber (not shown) is defined within the support member 152. Holes 160 are defined in the upper surface 151 and fluidly communicate with the chamber. A conduit 162 attaches to the support member 152 at one end and to a vacuum pump 164 at another end. Fluid communication is provided between the vacuum pump 164 and the support member 152 by conduit 162. A rotatable coupling 166 forms a part of the conduit 162. A motor 168 is mounted on a base 170, and a rotatable disk 172 is mounted on a shaft of the motor 168. A flexible endless belt 174 connects the disk 172 to the rotatable coupling 166.

Upon activation of the motor 168, the disk rotates, driving the belt 174. This causes the coupling 166 to rotate. Coupling 166 rigidly attaches to the support member 152 so that the support member rotates about the X axis relative to the remainder of the conduit 162, vacuum pump 164 and base 170.

Figure 14:
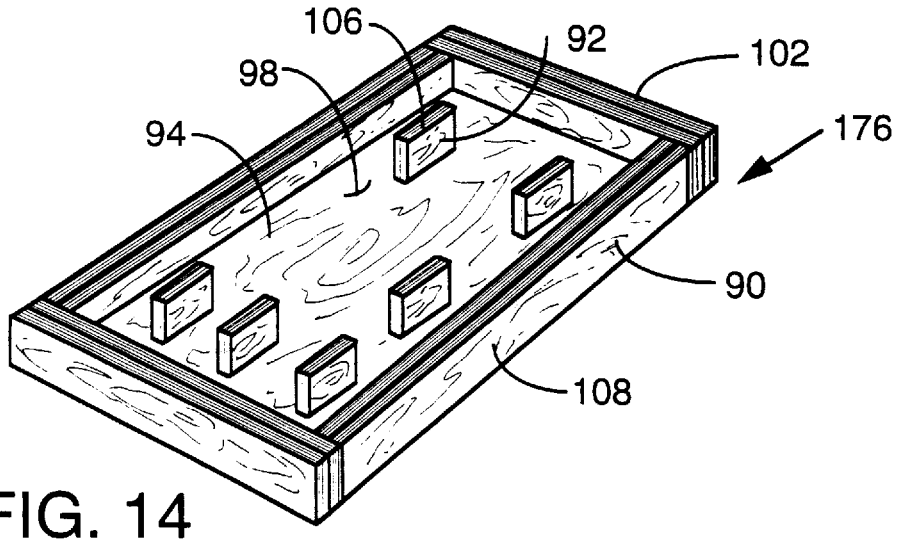
FIG. 14 is a perspective view of a subassembly made on the apparatus shown in FIGS. 12 and 13.
Figure 15:
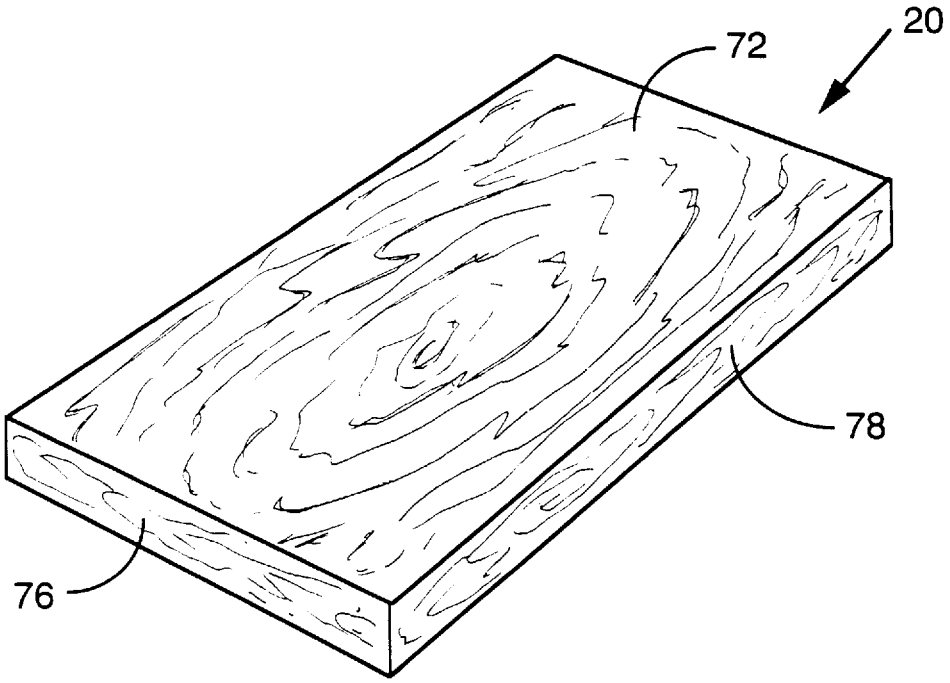
FIG. 15 is a hollow panel made from the subassembly shown in FIG. 14.

Referring to FIG. 13, in the manufacture of a panel in accordance with the present invention, rails 90 and blocks 92 are first placed in recesses 154 and 156 so that surfaces 100 and 104 face upwardly and surfaces 102 and 106 face downwardly to rest on lower surfaces that define the respective recesses 154 and 156. The rails 90 define the interior area 98 within which the blocks 92 are placed. A thick water-based adhesive or wood glue, such as Jowatt 102-30, is then applied or coated on the inner surface 94 of sheet 84. The coated surface 94 is then placed on surfaces 100 and 104 on the rails 90 and blocks 92. Vacuum pump 164 is activated, evacuating the interior area 98 through the holes 160 into the conduit 162 and out through the exhaust line of the vacuum pump 164. This causes sheet 84 to be forced onto the rails 90 and blocks 92. After the adhesive begins to cure and forms a subassembly 176 and while the interior area 98 is still evacuated, motor 168 is activated, rotating the disk 172. This causes the support member to rotate one hundred and eighty degrees (or thereabout) about the X axis and, in turn, rotates the subassembly 176 one hundred and eighty degrees (or thereabout) so that surface 151 changes orientation from an upwardly facing position to a downwardly facing position. Vacuum pump 164 is then deactivated and the interior area 98 is repressurized so that the subassembly 176 falls out of the template and rests on an outer surface of the sheet 84 on a supporting surface, such as a tabletop or a stack of finished panels. Surfaces 102 of rails 90 and surfaces 106 of blocks 92 are now exposed and positioned away and removed from the surface 151 of the support member 152 as shown in FIG. 14. A thick water-based adhesive is then coated on the unfinished inner surface 96 of sheet 86 and the inner surface 96 of the sheet 86 is then placed on unfinished surfaces 102 and 106 on the rails 90 and blocks 92. The adhesive coatings are then permitted to cure, thereby adhesively bonding the sheets 84 and 86 (through their unfinished surfaces 94 and 96) to surfaces 100 and 102 of rails 90 and surfaces 104 and 106 of blocks 92. Preferably, pressure is applied to the upper surface sheet 86 during the curing process. After the adhesive has cured, the outer surfaces 108 of the rails 90 can be modified in shapes as previously described and an edge band or veneer can be applied to the exposed rail surfaces to form a panel 20, as shown in FIG. 15. In lieu of applying the adhesive to the unfinished surfaces of the sheets 84 and 86, the adhesive can be applied to the respective unfinished surfaces of the rails 90 and blocks 92.

As can be seen, the template need not include recesses but may include markings or other indicia to indicate the proper placement of rails and blocks. An infinite number of templates for arranging the blocks and the rails in specific orientations for panels can be provided. The use of the template permits uniformity from panel to panel.

Further, any number of rails 90 can be positioned along the edges of the sheets. This depends on the particular application. As should be evident, the rails 90 are secured directly to the sheets 84 and 86, not to the adjacent rails. Therefore, the condition of the rail surfaces, with the exception of the surfaces 100 and 102, is irrelevant. Furthermore, the actual length L, height H and width W of the rails can vary from run to run to accommodate different offal and products. The same is true for the blocks 92. The actual strategic placement of the blocks is determined on a product-to-product basis taking into consideration the desired weight of the panel, the overall rigidity of the panel and the placement of hardware and holes in the panel.

Having described presently preferred embodiments of the invention, it is to be understood that it may be otherwise embodied within the scope of the appended claims.

We claim:

1. A method for manufacturing a panel, comprising:

locating offal pieces of wood products, wherein each of the offal pieces includes a finished surface, said offal pieces comprising scrap particle board sheets having a finished surface or scrap fiberboard sheets having a finished surface;

cutting the offal pieces into suitable lengths for rails and blocks, wherein the cut rails and blocks have at least two opposite unfinished surfaces for securing to the sheets and include a portion of the finished surface of a respective offal piece;

attaching unfinished surfaces of the rails about the perimeter of a first sheet using an adhesive, wherein the adhesive is capable of adhering to the unfinished surfaces but not capable to sufficiently adhere to said finished surfaces to form an adhesive bond between the finished surfaces and the sheets, thereby defining an interior area;

attaching unfinished surfaces of the blocks to the first sheet within the interior area using the adhesive that is capable of adhering to the unfinished surfaces but not capable to sufficiently adhere to said finished surfaces to form an adhesive bond between the finished surfaces and the sheets; and attaching a second sheet to unfinished surfaces of the rails and unfinished surfaces of the blocks using the adhesive so as to form a hollow panel.

2. A hollow panel made in accordance with the method set forth in claim 1.

3. A method as claimed in claim 1, further comprising the step of modifying an exposed surface of one of the rails after the hollow panel is formed.

4. A method as claimed in claim 3, further comprising the step of receiving a veneer surface to said modified surface.

5. A method as claimed in claim 3, wherein said modified surface is curved.

6. A method as claimed in claim 1, wherein the rails have outermost exposed rail surfaces facing away from the interior area, said method further comprising the step of modifying the exposed rail surfaces after the second sheet is attached to the rails and the blocks.

7. A method as claimed in claim 6, wherein said modifying step comprises removing the exposed rail surfaces.

8. A method as claimed in claim 7, wherein removing of the exposed rail surfaces is accomplished by machining.

* * * * *

UNITED STATES PATENT AND TRADEMARK OFFICE

CERTIFICATE OF CORRECTION

PATENT NO. : 5,832,692

DATED : November 10, 1998

INVENTOR(S) : Kevin W. Opferbeck et al.

It is certified that error appears in the above-identified patent and that said Letters Patent is hereby corrected as shown below:

Title Page, [56] References Cited, U.S. PATENT DOCUMENTS, refer to Patent No. 435,337, inventor: "Wassensius" should read --Wassenius--.

Column 5 Line 22 "panel Ill" should read --panel 111--.

Signed and Sealed this

Twenty-fifth Day of May, 1999

*Attest:*

*Attesting Officer*

Q. TODD DICKINSON

*Acting Commissioner of Patents and Trademarks*